US005462606A

United States Patent [19]

Burns

[11] Patent Number: 5,462,606

[45] Date of Patent: Oct. 31, 1995

[54] CHEMICAL SANITIZING OF FOODWARE

[76] Inventor: John R. Burns, 3003 Venture Ct., Export, Pa. 15632

[21] Appl. No.: 231,643

[22] Filed: Apr. 22, 1994

[51] Int. Cl.[6] ..... B08B 13/00

[52] U.S. Cl. ..... 134/18; 134/58 D; 134/56 D; 134/57 D; 134/95.1; 222/54

[58] Field of Search ..... 134/58 D, 57 D, 134/56 D, 95.1, 99.1, 100.1, 18, 56 R, 57 R, 58 R; 222/54; 422/292

[56] References Cited

U.S. PATENT DOCUMENTS

| | | | |
|---|---|---|---|
| 2,129,944 | 9/1938 | Ladewig . | |
| 2,592,884 | 4/1952 | Fox et al. . | |
| 2,621,673 | 12/1952 | Hodgens, Jr. | 134/57 D |
| 2,687,139 | 8/1954 | Noble et al. | 134/57 D |
| 2,859,760 | 11/1958 | Borell | 134/58 D |
| 2,963,029 | 12/1960 | Bock | 134/58 D |
| 3,049,133 | 8/1962 | Jacobs | 134/57 |
| 3,139,890 | 7/1964 | Moran | 134/100 |
| 3,370,597 | 2/1968 | Fox | 134/58 |
| 4,147,559 | 4/1979 | Fraula et al. | 134/57 |
| 4,235,642 | 11/1980 | Federighi et al. | 134/58 |
| 4,277,290 | 7/1981 | Andrews et al. | 134/10 |

*Primary Examiner*—Frankie L. Stinson
*Attorney, Agent, or Firm*—Carothers & Carothers

[57] ABSTRACT

In a commercial dishwashing machine the temperature of the final hot fresh rinsing water is sensed and sanitizer is injected into the rinsing water in a predetermined amount when the temperature of the hot rinsing water is sensed to be below a predetermined threshold minimum. The temperature sensing is accomplished with an electrical sensing device. The electrical temperature sensing device energizes the sanitizer for injection of sanitizer into the rinse water preferably within a predetermined temperature range of the hot rinsing water defined at a bottom limit by a threshold minimum and at an upper limit by a threshold maximum temperature.

16 Claims, 2 Drawing Sheets

CHEMICAL SANITIZING OF FOODWARE

BACKGROUND OF THE INVENTION

This invention relates to apparatus and methods for continuous or batch type low temperature cleansing of foodware items in commercial dishwashers.

Hot water sanitizing type dishwashers rely on the use of high temperature (180° F. and above) water in order to sanitize the foodware items in the final rinse stage. If, however, a limited capacity of hot water is available and the temperature thereof falls below the required level for destruction of bacterial and microbial life, other precautions must be taken to sanitize the foodware items in the final rinse.

In this instance, some commercial dishwashers use a so called "booster heater" which either has an electrical heating element or a gas burner heater in the dishwashing machine to heat the rinse water to a higher level. However this added equipment is inherently expensive in the manufacture of the dishwashing machine and is also expensive to operate.

Other commercial dishwashing machines, see for example U.S. Pat. No. 4,277,290 issued to Andrews et al. for Low Temperature Washing and Chemical Sanitizing of Foodware, automatically and regularly inject a liquid chemical sanitizing agent into the flow of water in the rinse line. Typical sanitizers are the hypochlorides, chloramines and other organic chlorine-liberating compounds, quaternary ammonium compounds, and certain iodophors. The chlorine -liberating compounds are generally preferred.

A general problem with the commercial dishwashing machines of the prior art, when utilized for low temperature washing and chemical sanitizing of foodware, is that they automatically inject a sanitizer to the rinse water, either before or after the discharge of the rinse water into the dishwasher chamber, whether or not the rinse water temperature is in and of itself adequately high to sanitize the foodware items, thereby wasting sanitizer even when the rinse water temperature is sufficiently high.

It is a principal object of the present invention to eliminate this shortcoming and to further provide a commercial dishwasher which also eliminates the need or requirement of utilizing any type of booster heater for heating the final rinse water for the purposes of sanitizing.

SUMMARY OF THE INVENTION

The sanitizing rinse system of the present invention for commercial dishwashing machines supplies a chemical sanitizing agent in a uniformly distributed and predetermined concentration in the final rinse water only when the hot rinse water temperature falls below a predetermined threshold, such as 180° F.

A controlled means or mechanism is provided for sensing the temperature of the hot fresh water supplied from the source and when the temperature of the hot rinsing water is sensed to be below a predetermined threshold minimum, the control is thereby actuated to inject sanitizer into the rinsing water either optionally before or after discharge of the rinsing water into the cleansing chamber of the dishwashing machine.

This temperature sensing is accomplished with an electric or electronic sensor which provides an electrical signal when the temperature is sensed to be below the predetermined threshold minimum. The sanitizer is then injected into the rinse water in response to this electrical signal.

When the temperature of the rinse water is sufficiently high to sanitize the foodware items, the signal is not generated and no chemical sanitizer is injected into the rinse water.

The temperature sensor may be mounted in the sump, but preferably is mounted in the final rinse line supplying the hot water rinse and it is further provided with a variable range that may be adjusted or preset to turn on at a different temperature than its turnoff temperature. This prevents unnecessary fluxuation of turn on and turn off in the event that the rinse water temperature hovers about the minimum threshold.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention, wherein:

DETAILED DESCRIPTION OF A PREFERRED EMBODIMENT

The present invention may be utilized, as previously explained, with either the batch type or continuous type commercial dishwasher. For convenience sake, the present invention is explained in connection with the batch type dishwasher, and in particular is described as being mounted in the dishwasher disclosed in the aforesaid U.S. Pat. No. 4,277,290. Accordingly, drawings and description have been copied from that patent reference into the present specification, with modifications as required to show the installation of the apparatus and method of the present invention.

Thus, any details regarding operation of the dishwashing apparatus, which do not directly pertain to the present invention, and are not fully understood, reference should be made to this patent reference for a detailed explanation and understanding.

Figure 1:
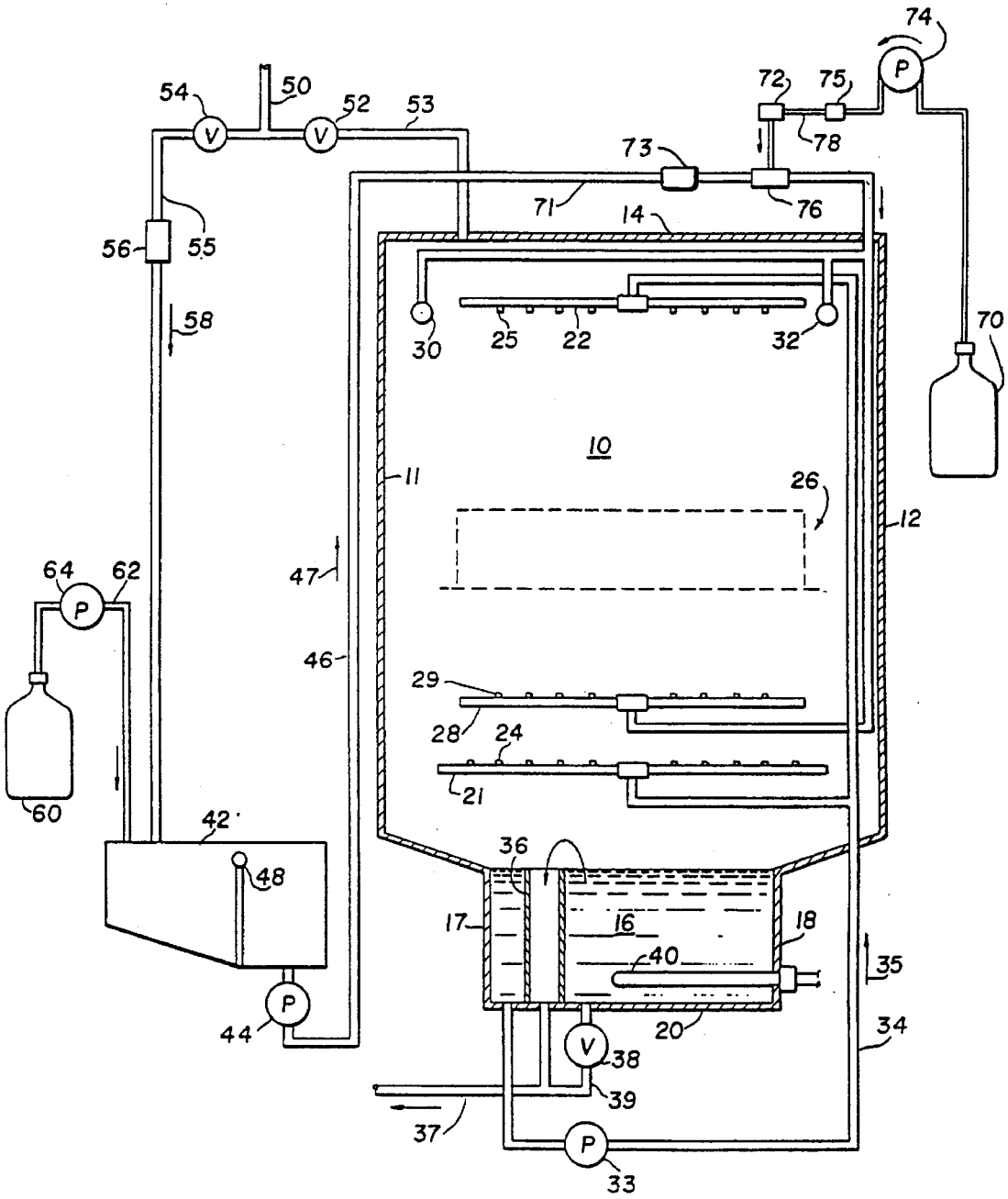
FIG. 1 is a schematic general arrangement view, partially in cross-section, of a batch-type, low temperature dishwashing apparatus embodying the present invention.

In the batch-type, low-temperature wash and chemical sanitizing dishwasher of FIG. 1, a common cleansing chamber 10 is provided for washing and rinsing of foodware items. Chamber doors (not shown) provide access for loading and unloading of the chamber 10 with a tray 26 of dishes, glasses, utensils, or similar items which are to be cleaned and treated to reduce bacterial life to a prescribed level.

Chamber 10 is defined by side walls 11 and 12, top wall 14, and an integral wash water sump 16; the latter is defined by side walls 17, 18 and bottom wall 20.

Wash spray arms 21 and 22 are mounted within chamber 10 to be rotatably driven by the force of high velocity jets of wash water exiting from nozzles such as 24 and 25. Wash spray arm 21 is located below and wash spray arm 22 is located above an open mesh rack and tray shown in broken lines at 26 in chamber 10.

Rinse spray means in chamber 10 include a lower, rotatable, rinse water spray arm 28, with nozzles such as 29, and fixed rinse nozzles, such as 30, 32, distributed about the upper portion of chamber 10.

Wash water from sump 16 is pressurized to desired pressure by wash pump 33. A predetermined concentration of detergent can be maintained in wash sump 16 automatically by commercially available means, the operation of which is well known and requires no further description to an understanding of the invention.

During a wash phase, wash water is pumped through wash water standpipe 34, as indicated by arrow 35, to wash spray arms 21 and 22. Wash solution, after spraying, drains into sump 16.

Similarly, during the rinse phase, rinse solution drains, after spraying of the load, into wash sump 16. An overflow pipe 36 leading to drain line 37 removes excess water providing flotation skimming of food particles.

Sump drain valve 38 permits complete drainage of sump 16 through drain pipe 39 for periodic cleaning or shutdown.

Means are provided for selected machine augmented heating of wash water. In the illustrated embodiment, an electrically powered heating coil 40 is submerged below water level in wash sump 16. Operation in accordance with the invention limits heat augmentation to the standby condition. Heater coil 40 is operable only when immersed in wash water and is controlled to be operable only when thermostatically required in the absence of machine cycling.

A separate fresh water accumulation tank 42 is provided. Tank 42 has a capacity in proportion to the dishwashing apparatus and the capacity of wash sump 16. After accumulation of a prescribed volume of fresh water, rinse pump 44 drains tank 42 and pressurizes the fresh water to a desired level for flow through standpipe 46, in the direction indicated by arrow 47, toward spray means within chamber 10.

A water level sensor 48, which can be a conventional float type for providing on/off electrical signal control of fresh water supply, is mounted within fresh water accumulation tank 42.

Water is supplied through water source pipe 50. Valve 52 in line 53 can be manually or electrically operable. Filling wash sump 16, through line 53, is part of establishing the standby condition for machine cycling.

The capacity of wash sump 16 and the volume of fresh water accumulated in tank 42 are proportioned to maintain desired wash water characteristics, wash water temperature, and wash water level in sump 16 during cycling through drainage of chemically sanitizing rinse water into sump 16 after rinse spraying. Therefore, sump 16 is filled through line 53 only when initiating a standby condition. Valve 38 is closed during cycling and remains closed when the machine is in standby condition.

Electrically operable solenoid valve 54 provides on/off controlled flow of fresh water, preheated at the installation site, through pipe 55.

An important aspect in maximizing the time for accumulation of preheated fresh water and minimizing energy demand rate at the installation site is the flow rate regulation which provides for accumulating fresh water in tank 42 during substantially all, or under a controlled major portion of the wash phase time. Flow regulator 56, shown schematically in FIG. 1, preferably provides both selection of water pressure for fresh water and throttling of fresh water flow rate. Direction of fresh water flow toward tank 42 is indicated by arrow 58.

While operation of on/off solenoid valve 54 can be time controlled for desired maximum utilization of wash phase time, provision is made for making valve 54 responsive to water level sensor 48 in fresh water accumulator tank 42 under certain circumstances when a prescribed fresh volume may accumulate in slightly less than the full wash phase time.

Utilizing all or substantially all of the wash phase time for accumulating fresh water has important advantages in minimizing the energy demand rate for water temperature recovery at the site. Use of flow rate regulation features as taught makes the cycle economically and automatically adaptable to varying conditions at an installation site or at differing installation sites.

A drying agent, which facilitates spot-free drying, can be added to fresh water accumulator tank 42 from additive reservoir 60 through tube 62 by metering pump 64. Other means can be provided for introducing such an additive into accumulator tank 42 at the proper time in the cycle.

Chemical sanitizer may be, but is not added into the fresh water accumulator tank 42. Liquid chemical sanitizing agent is introduced directly into a rinse line, e.g. by pressurized, metered injection. As shown in FIG. 1, when called for, liquid chemical sanitizer is pumped into water flowing in line 71 by injector 72 shortly prior to spraying through the rinse nozzles within chamber 10.

A positive pressure pump 74, such as a peristaltic pump of selected size proportional to the use, is time controlled to accurately meter chemical sanitizing agent from reservoir 70 into the pressurized fresh water flow during substantially the full rinse phase time. Check valve 75 protects pump 74 from the pressured imparted by pump 44 and helps increase the life of peristaltic type metering pumps.

Figure 2:
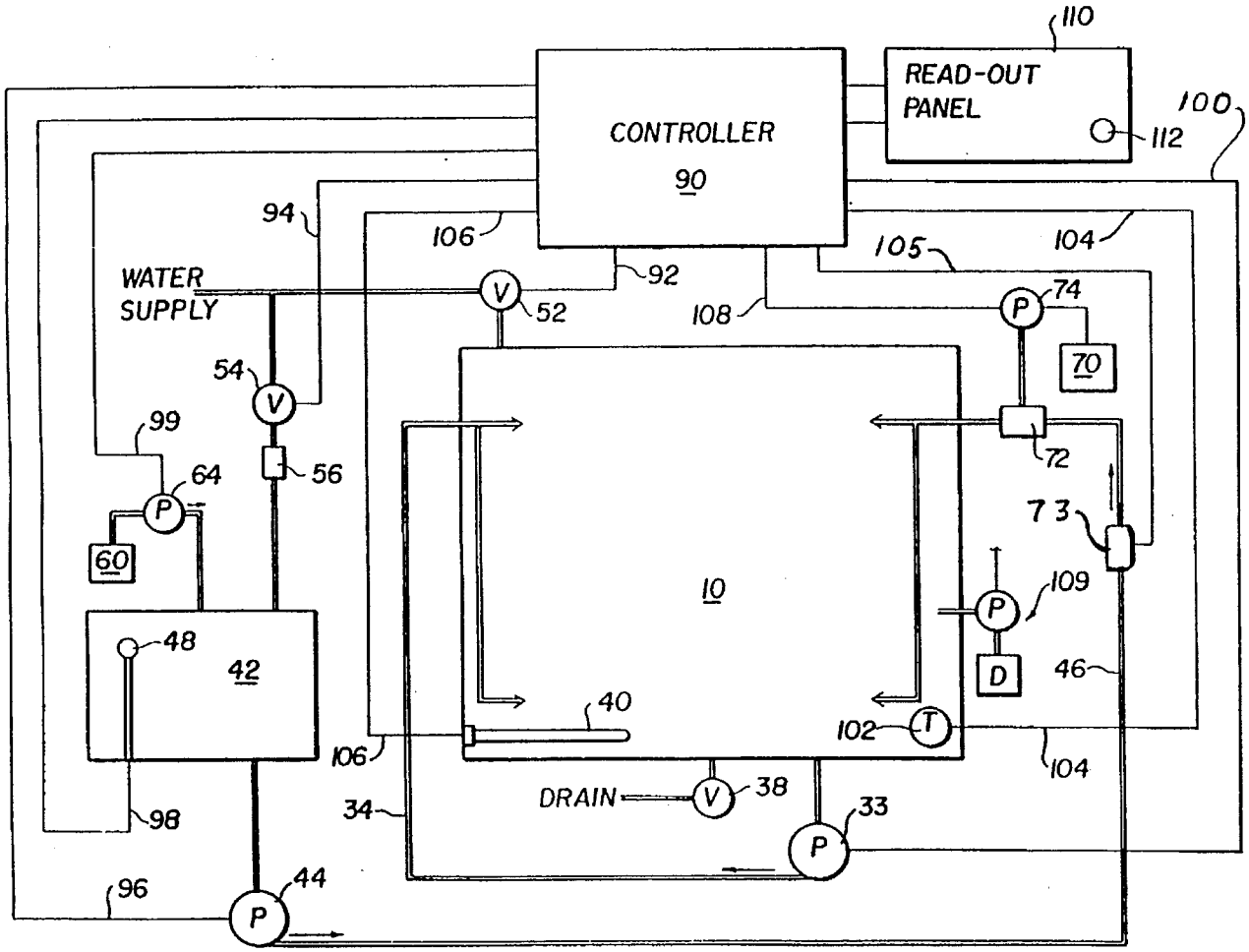
FIG. 2 is a schematic of apparatus embodying the invention for regulating the use of washing and chemical sanitizing agents in the final rinse for the apparatus illustrated in FIG. 1.

Injector 72 is mounted in rinse line 71 so as to facilitate injection and mixing. As shown in FIG. 2, a connector "T" 76 is mounted in line 71 contiguous to its point of entry into chamber 10. Water flow in line 71 is indicated by arrow 77. Injector 72, connected to liquid chemical sanitizing agent tube 78, directs chemical sanitizing agent along conduit 80 to outlet 82; the latter opens within the flow stream so as to provide injection having a directional component in the direction of water flow.

By introducing the sanitizer directly into the water flow shortly prior to rinse spraying, evaporative loss of sanitizing capabilities in fresh water holding tank 42 is avoided. Also, when a drying agent from reservoir 60 is added to tank 42, the widely separate points of addition of sanitizer and drying agent, and the short interval of contact of such drying agent rinse additive and injected chemical sanitizing agent before spraying, helps to relieve concern about compatibility of rinse additives and chemical sanitizing agents, or concern with a disassociation which could reduce sanitizing effectiveness when both agents are utilized and premixed for some time at 140° F. prior to spraying.

In the automatic dishwasher schematic of FIG. 2, controller 90 provides automatic timed control of electrically operable solenoid valves and pumps such as those shown in FIG. 1 (the same reference numbers are used in the drawings for elements having the same function). Wash sump fill valve 52 can be manually operated, or connected to controller 90 through control line 92 and controlled to remain closed after filling sump 16 to place the unit in standby condition.

Electrical control for fresh water supply valve 54 is connected to controller 90 through control line 94 and electrical actuating control for pump 44 is connected through control line 96. The electrical signal from float switch 48 is connected through line 98; drying agent pump 64 is connected through control line 99 and wash pump 33 is connected through line 100. The electrical signal for sump wash water temperature, measured at temperature bulb 102, is connected through line 104 and on/off control signal for standby eater 40, which is responsive to temperature sensing bulb 102 during standby conditions, is connected through line 106. Electrical actuation of chemical sanitizer pump 74 is connected through line 108. Detergent can be automatically injected for each wash cycle by detergent injector means 109 which can be actuated by controller 90 or otherwise automatically operable.

Readout panel 110 can be utilized to indicate the phase in operation during a cycle, the time, the temperature of the water in wash sump 16, or other values; also, cycle start button 112 can be mounted on readout panel 110.

For a more detailed understanding of the operation of the automatic dishwasher, further reference should be made to U.S. Pat. No. 4,277,290 as previously explained. The specific embodiments of the present invention in combination with the dishwasher will now be explained.

The method and apparatus of the present invention incorporates control means or mechanisms for sensing the temperature of the hot fresh water supplied in the final rinse line 71. This control includes a temperature sensing device 73 which is adapted to actuate pump 74 through controller 90 only when the hot fresh water temperature is sensed by sensor 73 to be below a predetermined threshold minimum.

Temperature sensor 73 may be commonly found on the market as manufactured by a number of different manufacturers, such as Thermic, Inc.

Temperature sensor 73 is preferably adapted to actuate the chemical sanitizing source 70 via electrical connection 104 to controller 90 and connection on 108 to pump 74 only within a predetermined temperature range of the hot water rinse supply, which is defined at a bottom limit by a threshold minimum and at an upper limit by a threshold maximum temperature. This prevents fluxuation of the control on and off when the temperature of the fresh hot water supply fluxuates about the predetermined threshold minimum. For example, when the water temperature for the final rinse drops below 180° F. the controller 90 automatically turns the sanitizing pump 74 on and delivers the sanitizer to the final rinse line. The temperature sensor 73 is designed so that it turns on at a different temperature than it turns off.

Temperature sensor 73 passes an electrical signal which is permitted to pass through a bimetal or other type temperature switch when it senses the predetermined threshold minimum.

I claim:

1. A sanitizing rinse system for use in a dishwashing machine for supplying a predetermined quantity of rinse solution comprised of hot fresh water and a chemical sanitizing agent uniformly distributed therein at a predetermined concentration, and for spraying the solution onto foodware items, such as dishes, within a chamber in the dishwasher, comprising:

(a) rinse nozzles for spraying the rinse solution onto the items within the chamber;

(b) a source of hot fresh water connected for introducing and circulating such fresh water as rinse water to said rinse nozzles;

(c) a source of chemical sanitizing agent connected and constructed for introducing a predetermined quantity thereof into said rinse water when actuated for providing said rinse solution; and (d) control means for sensing the temperature of said hot fresh water and actuating said chemical sanitizing agent source for metering a predetermined quantity of said sanitizing agent into said rinse water when said hot fresh water temperature is sensed by said control to be below a predetermined threshold minimum.

2. The sanitizing rinse system of claim 1 wherein said control means is adapted to actuate said chemical sanitizing source only within a predetermined temperature range of said hot water which is defined at a bottom limit by said threshold minimum and at an upper limit by a threshold maximum temperature.

3. The sanitizing rinse system of claim 1 wherein said chemical sanitizing agent source is constructed to meter said agent into said hot fresh water prior to discharge thereof into said dishwasher chamber.

4. The sanitizing rinse system of claim 1 wherein said sanitizing agent is a liquid selected from a group consisting of a chlorine-liberating compound, a quaternary ammonium compound, and an iodophor.

5. The sanitizing rinse system of claim 4 wherein said control means includes a peristaltic pump for metering said sanitizing agent.

6. In combination with a dishwashing machine having a cleansing chamber, a sump for said chamber, means including a motor driven pump and a spray device connected to spray cleansing liquid over soiled articles in said chamber and to recirculate the sprayed liquid from the pump through said spray device, automatically operable fill and drain valves for controlling the supply and the drainage of water to and from said sump, and a cycle control means connected to operate said valves and said pump in a desired sequence including at least one washing cycle and one final rinsing cycle during each of which fresh water is supplied from a hot water source to said sump, a supply reservoir for containing sanitizer liquid, metering means having an inlet connected to said reservoir and an outlet passage opening into said cleansing chamber to transfer a predetermined amount of sanitizer liquid into said cleansing chamber for mixture with the fresh water; the improvement comprising temperature sensing means connected to said fresh water supply for sensing the temperature of said fresh water during said one final rinsing cycle and adapted to energize said metering means for the supply of sanitizer to said chamber when said temperature sensing means senses a hot water temperature below a predetermined threshold.

7. The combination of claim 6 wherein said metering means meters said sanitizer into said hot fresh water prior to discharge thereof into said cleansing chamber.

8. The combination of claim 6 wherein said sanitizer is a liquid selected from a group consisting of a chlorine-liberating compound, a quaternary ammonium compound, and an iodophor.

9. The combination of claim 8 wherein said temperature sensing means is adapted to actuate said metering means only within a predetermined temperature range of said hot water defined at a bottom limit by said threshold minimum and at an upper limit by a threshold maximum temperature.

10. The combination of claim 8 wherein said temperature sensing means includes a peristaltic pump for metering said sanitizer.

11. A method for washing and sanitizing dishes or other articles comprising:

a) placing articles to be washed into the cleansing chamber of a dishwashing machine;

b) spraying cleansing liquid over the soiled articles;

c) draining the cleansing liquid;

d) rinsing the dishes with hot rinsing water;

e) sensing the temperature of the rinsing water;

f) Injecting sanitizer into the rinsing water in a predetermined amount when said temperature of said hot rinsing water is sensed to be below a predetermined threshold minimum.

12. The method of claim 11 wherein the step of sensing is accomplished with electric sensing means which provides an electrical signal when said temperature is thereby sensed to be below the predetermined threshold minimum, and said step of injecting is done in response to said signal.

13. The method of claim 12 wherein the step of injecting sanitizer is done only within a predetermined temperature range of said hot rinsing water defined at a bottom limit by said threshold minimum and an upper limit by a predetermined threshold maximum temperature.

14. The method of claim 12 wherein the step of injecting includes the metering of said sanitizer into the rinsing water through the use of a peristaltic pump.

15. The method of claim 12 wherein the step of injecting is carried out by injecting the sanitizer into the hot rinsing water prior to discharge thereof into said cleansing chamber of said dishwashing machine.

16. The method of claim 12 wherein said sanitizer is selected from a group consisting of a chlorine-liberating compound, a quaternary ammonium compound, and an iodophor.

* * * * *